US009492823B2

(12) United States Patent
De Gier et al.

(10) Patent No.: US 9,492,823 B2
(45) Date of Patent: Nov. 15, 2016

(54) MANIFOLD FOR A FLUIDIC CARTRIDGE

(75) Inventors: Ronald De Gier, Eindhoven (NL); Arthur R Van Es, Eindhoven (NL); Peter Wilnauer, Wackersdorf (DE)

(73) Assignee: BIOCARTIS NV, Mechelen (BE)

( * ) Notice: Subject to any disclaimer, the term of this patent is extended or adjusted under 35 U.S.C. 154(b) by 1174 days.

(21) Appl. No.: 13/503,407

(22) PCT Filed: Oct. 20, 2010

(86) PCT No.: PCT/CH2010/000264
§ 371 (c)(1),
(2), (4) Date: Sep. 10, 2012

(87) PCT Pub. No.: WO2011/047494
PCT Pub. Date: Apr. 28, 2011

(65) Prior Publication Data

US 2012/0325334 A1 Dec. 27, 2012

(30) Foreign Application Priority Data

Oct. 21, 2009 (EP) ..... 09173604

(51) Int. Cl.
*B01L 3/00* (2006.01)

(52) U.S. Cl.
CPC .. *B01L 3/502738* (2013.01); *B01L 2300/0861* (2013.01); *B01L 2400/0644* (2013.01); *Y10T 137/598* (2015.04); *Y10T 137/6851* (2015.04); *Y10T 137/85938* (2015.04)

(58) Field of Classification Search
CPC ..... A61M 31/00; B01L 3/00
See application file for complete search history.

(56) References Cited

U.S. PATENT DOCUMENTS 5,433,705 A * 7/1995 Giebel ..... A61M 39/162 604/265
5,685,866 A * 11/1997 Lopez ..... A61M 5/14 604/249
2006/0150385 A1 7/2006 Gilligan et al.
2007/0280855 A1 12/2007 Matteo

FOREIGN PATENT DOCUMENTS

CN 101142433 3/2008 ..... F61L 37/252
CN 101495850 7/2009 ..... G01N 15/06
EP 1914492 4/2008 ..... F25B 9/00
GB 2 421 202 A 6/2006 ..... B01L 3/00
WO 94/04929 A1 3/1994

OTHER PUBLICATIONS

International Search Report from corresponding International Application No. PCT/CH2010/000264 dated Apr. 12, 2011.
Written Opinion from corresponding International Application No. PCT/CH2010/000264 dated Apr. 21, 2012.
Kaldari, et al., Wikipedia entry entitled: "Undercut (manufacturing)," website printout from http://en.wikipedia.org/w/index.php?title=Special:Book&bookcmd=download&collection_id=0675c42aa97101bf2d7c22f551aaa62ca965a8d4&writer=rdf2latex&return_to=Undercut+%28manufacturing%29 retrieved Jul. 8, 2016.

* cited by examiner

*Primary Examiner* — Jyoti Nagpaul
(74) *Attorney, Agent, or Firm* — Kusner & Jaffe

(57) ABSTRACT

A manifold system is provided that includes a manifold housing and a manifold core. The manifold housing is configured to receive the manifold core. The manifold housing includes an oblique inner surface and at least one fluidic channel. The fluidic channel ends with one of its ends at the oblique inner surface. The manifold housing together with the at least one fluidic channel has no undercut.

28 Claims, 4 Drawing Sheets

MANIFOLD FOR A FLUIDIC CARTRIDGE

CROSS REFERENCES TO RELATED APPLICATIONS

This application claims the priority of European patent application 09173604.1, filed Oct. 21, 2009, the disclosure of which is incorporated herein by reference in its entirety.

FIELD OF THE INVENTION

The invention relates to cartridges for fluidic applications with a manifold functionality. In particular the invention relates to a cartridge for fluidic or microfluidic applications with a manifold housing and to a manifold core for inserting into a manifold housing of a cartridge.

BACKGROUND OF THE INVENTION

A way of implementing multiple valve functions in a cartridge is the usage of a manifold. The advantage in this is that with limited actuation interfaces multiple connections can be made. The construction of a manifold requires special techniques and is not straightforward when using e.g. injection moulding.

However, if the manifold is shaped as a cylinder with connections hooking up to the wall of the cylinder, sliders are needed in the mould during manufacturing. Such sliders make the mould more complex, more expensive and more susceptible to wear and tear. An alternative described in the state of the art is to position the connections radial at one of the flat ends of a cylindrical manifold. However, in this configuration relatively large forces are needed to keep connections fluid-tight. Generating such forces makes a device more complex and more susceptible to leaks. In general these forces cannot be made within disposable plastic cartridges. Therefore always an additional instrument is needed to create a leak tight connection, meaning that when the disposable cartridge is unloaded, the leak tight connection is unlocked which may lead to leakages to the outside of the disposable cartridges.

SUMMARY OF THE INVENTION

It may be seen as an object of the invention to provide for a manifold having a plurality of fluid connections and being easily manufacturable on the one hand and without the need for relatively large anti-leakage forces on the other hand.

The described embodiments similarly pertain to the manifold housing, the cartridge comprising a manifold housing and to the manifold core for inserting into a manifold housing. Synergetic effects may arise from different combinations of the embodiments although they may not be described in detail.

According to a first exemplary embodiment of the invention, a manifold housing for a cartridge and for receiving a manifold core is provided. The manifold housing comprises an oblique inner surface, at least one fluidic channel wherein the fluidic channel ends with one of its ends at the oblique inner surface. Furthermore, the manifold housing together with the at least one fluidic channel has no undercut.

In other words, the way that the manifold housing is shaped and constructed, i.e. the partially oblique embodiment of the inner wall of the manifold housing and the way the fluidic channel extends, makes it possible to use a mould with simple pins to generate the fluidic channel in the oblique part of the manifold housing. Such a manifold housing can easily be released from the mould once such moulding is complete and no sliders need to be used during the cast moulding.

The oblique inner surface of the manifold housing is furthermore the sealing surface that leads to a fluid-tight connection between the manifold housing and the manifold core when the core is integrated into the manifold housing. Therefore, the connecting fluidic channels can be made from the underside. This makes it very easy for the mould, since no undercuts are present in the design of the manifold housing and the mould can be made without any sliders. Thus, a manifold housing which is constructed according to this exemplary embodiment of the invention has the easy manufacturability which is desired during cast moulding. Furthermore, there is no need for a relatively large anti-leakage force.

This means that there is no need for large external forces applied by an additional instrument. According to this embodiment of the invention these forces are generated by the combination of the manifold core and housing and are within the disposable cartridge construction. Due to the partially cylindrical shape of the housing and core, the construction may be so stiff that it may withstand the forces that are needed to make a leak tight connection and also keep the forces over a longer period of time, being e.g. shelf life of the cartridge. This, a disadvantageous, large anti-leakage forces creating instrument is not needed due to the combination of oblique parts in the manifold housing and the manifold core.

Contrary to a totally cylindrical manifold housing, the present embodiment of the invention combines a hole having an oblique surface in the manifold housing with a core having a corresponding oblique surface. The two corresponding oblique surfaces lead to a fluid-tight connection between the manifold housing and the manifold core.

In the present application, the oblique inner surface is understood as a surface that is neither a horizontal surface nor a vertical surface. In the upper embodiment of an essentially cylindrical manifold housing, the oblique inner surface neither is perpendicular to a cylindrical main axis of the cylinder nor is it parallel to such axis. The oblique inner surface shows both a vectorial component that is perpendicular to the cylindrical main axis, and a vectorial component that is parallel to the cylindrical main axis. It is noted that preferably the oblique inner surface is a surface generated by revolution of a graph/line around the cylindrical main axis. The graph may be embodied as a straight graph or a curved graph. The graph fulfils the condition that the resulting manifold housing can be injection moulded without undercuts in combination with the fluidic channel. Advantageously, the graph represents a monotonically increasing function with a starting point and an ending point wherein the starting point is closer to the cylindrical main axis than the ending point in a radial direction. Advantageously, the graph is a straight line, and the resulting inner surface determined by revolution of the graph is a conical surface or a segment of a cone. In another embodiment, the graph is a segment of a circle, and the resulting inner surface determined by revolution of the graph is a spherical segment. Note that the inner surface does not necessarily need to represent a full revolution of the graph: In embodiments, a partial revolution may be sufficient to determine an inner surface of the manifold housing.

For the reason that an outer surface of the manifold core preferably corresponds with the inner surface of the manifold housing, the above definition may also apply to the outer surface of the manifold core, and in particular, the outer surface may also have a conical shape.

The fluidic channel may be a 3-dimensional channel that is entirely defined by the outer and inner surface of the manifold housing. It may be provided for connecting, for example, storage chambers of the cartridge with the manifold core that is to be inserted and that might be interconnected with an interface to a desired instrument.

In other words, the manifold housing is used to implement multiple valve functions in a multi-chamber cartridge. Therefore, the advantage of central actuation can be used, which actuation may be directed to several chambers of the cartridge via choosing a fluidic channel by switching the manifold core inside the manifold housing from one position to another.

The oblique part that comprises the oblique inner surface may be truncated from the rest of the manifold housing. The trunctation may be made to ease the manufacturing even more. Due to the truncation, the walls of the cartridge may be kept relatively thin, which may be an essential advantage for an injection moulding process.

Besides the oblique inner surface the rest of the manifold housing may be shaped essentially cylindrically. In detail the manifold housing may have an essential shape of a hollow cylinder with a cylindrical main axis elongating along the main cavity inside the hollow cylinder. Thus an essentially annular inner surface and an essentially annular outer surface may be comprised in the manifold housing. In such a case the oblique surface has a vectorial component that is perpendicular to the cylindrical main axis. In this case the oblique surface is part of the inner surface of this hollow cylinder. In other words a plurality of fluidic channels inside the manifold housing may be used without necessitating the use of sliders during cast moulding, wherein the fluidic channels have respective openings along different positions on the annular inner oblique surface which positions may preferably also vary in their levels along the longitudinal main axis of the manifold housing. Therefore reduced production costs of the manifold housing and an increased reliability of the production of the manifold housing may be achieved by this exemplary embodiment.

The oblique inner surface of the manifold housing and the corresponding interconnection surface of the manifold core which may also be embodied as a oblique surface may both be called "sealing surfaces". By means of the interconnection of the two surfaces, the fluid-tight connections that are necessary may be built.

In a preferred embodiment of the invention, the manifold housing may be an integral part of the cartridge but may also be a physically separated part or component that is to be integrated in a desired way into the cartridge. In other words, it may be possible to produce a cartridge having such a manifold housing as an integral part. But also a production process in which only the manifold housing according to this and every other exemplary embodiment is produced is possible.

According to another exemplary embodiment of the invention, the fluidic channel is integrated into the manifold housing and in the oblique surface in such a way, that no undercut during cast moulding of the manifold housing is generated.

The oblique inner surface of the manifold housing allows the design of several possible fluidic channel shapes that in turn allow the production of the manifold housing with simple pins during cast moulding. The need of using sliders is avoided by this exemplary embodiment of the invention. Thus, the production process of such a manifold housing is easy, inexpensive and the mould is reduced in its susceptibility to wear and tear. Therefore, a longer-lasting mould may be provided when such a manifold housing is constructed.

According to another exemplary embodiment of the invention, the fluidic channel separates the manifold housing in a cross-sectional view into an inner part and an outer part. Furthermore, a radial direction from a central axis of the manifold housing to the outer surface is defined. The inner part of the manifold housing extends from a first inner radial value d1 to a first outer radial value d2. The outer part of the manifold housing extends from a second inner radial value d3 to a second outer radial value d4 and wherein d2 is smaller than or is equal to d3.

This exemplary embodiment of the invention may for example be seen in FIG. 4, in which a cross-sectional view of one part of a manifold housing is depicted. This exemplary embodiment of the invention shows a manifold housing with an inner oblique surface and shows a specific design of the fluidic channel. Both in combination allow the production of such a manifold housing by cast moulding with a two-part mould. Additionally, this may be done without having the need to use sliders. This makes the construction of such a manifold housing simple, easy and reliable According to another exemplary embodiment of the invention, the oblique inner surface of the manifold housing is arranged in a proximal region of the manifold housing.

Thereby the term "proximal region" defines the region of the manifold housing, which is situated adjacent to the cartridge. If the manifold housing is an integral part of the cartridge a proximal region of the manifold housing is that region of the manifold housing in which the connection between the manifold housing and the cartridge is situated.

In other words, the manifold core is inserted into the manifold housing by inserting it from a region distal to the proximate region through, for example, the cavity in the hollow cylindrical shape of the manifold housing towards the proximal region. In the proximal region, the oblique outer surface of the manifold core and the oblique inner surface of the manifold housing are brought into contact, which process establishes a fluid-tight connection between these parts via the fluidic channel of the housing and the opening on the oblique surface of the manifold core. Additionally, locking mechanisms, like for example locking detents may be part of both the manifold core and the manifold housing. Also, corresponding detent pockets may be present in order to substantially fix the core in the housing in order to create the needed anti-leakage forces to establish fluid-tight connections.

According to another exemplary embodiment of the invention, the manifold housing essentially has the shape of a hollow cylinder, wherein the oblique inner surface forms an inner surface of the hollow cylinder in a proximal region of the manifold housing. The hollow cylinder has a first hole at a proximal end of the manifold housing and a second hole at the distal end of the manifold housing wherein the manifold housing is adapted for receiving the manifold core through the second hole. This embodiment of the manifold housing allows the insertion of the manifold core through the second hole at the distal end. After having inserted the manifold core into the manifold housing and after the fluid tight connection has been established via, for example, locking detents and locking pockets, the first hole of the hollow cylinder at the proximal end is entirely closed by the manifold core.

According to another exemplary embodiment of the invention, the fluidic channel extends in the manifold housing from a bottom of the cartridge to the oblique inner surface of the manifold housing.

This exemplary embodiment of the invention may for example be seen in FIG. 2. In other words the fluidic channel has one end and thus an opening in the oblique inner surface which is a sealing surface for the fluid connection that is to be established. The fluidic channel has a second end, which is at the bottom of the cartridge. From this end of the fluidic channel a supply channel may extend from the fluidic channel into e.g. storage chambers that may be part of the multichamber cartridge.

According to another exemplary embodiment of the invention, the manifold housing comprises a plurality of fluidic channels wherein the oblique inner surface is an annular surface and wherein the oblique inner surface is positioned at a proximal part of an inner surface of the manifold housing. Each fluidic channel ends at the oblique inner surface with an opening into an inner hollow cavity of the manifold housing. The fluidic channels are adapted to establish different fluidic connections with the manifold core when the manifold core is inserted into the manifold housing. In a preferred embodiment, at least two of the openings into the hollow cavity are arranged at different levels of the oblique inner surface along a longitudinal axis of the manifold housing. In another preferred embodiment, at least two of the openings into the hollow cavity are arranged at different angular positions around the perimeter of the oblique inner surface.

In other words multiple valve functions are provided by means of the combination of the manifold housing with the manifold core for in particular microfluidic applications in a in particular microfluidic cartridge with several different chambers. Thus, with limited actuation interfaces multiple connections are made by this manifold system of the cartridge. For example, an actuation instrument is connected with the manifold core and has an effect on several cartridge chambers by means of the manifold functionality. Furthermore, the oblique part may be truncated.

As may be seen from FIG. 1, a plurality of openings may be comprised within the manifold core and correspondingly a plurality of fluidic channels may be comprised within the manifold housing. By rotating the manifold core, several different combinations of openings of the manifold core and fluidic channels of the manifold housing can be established. An opening of the fluidic channel may be aligned with an opening in the core in one or more angular positions of the core with respect to the manifold housing. One or more openings may be arranged in the manifold housing each of which only interacts with one corresponding opening in the core in a specific angular position of the core. Or, there may be arranged one or more openings in the manifold housing each of which interacts with more than one designated opening in the core in different angular positions of the core. Or, there may be arranged one or more openings in the core each of which interacts with more than one opening in the manifold housing at a specific angular position. In another embodiment, for the same angular position of the core, multiple openings of the core are simultaneously aligned with associated openings in the manifold housing.

According to another exemplary embodiment of the invention, the manifold housing is made by cast moulding.

Due to the partially oblique shape of the manifold housing and the way the fluidic channel is embodied, it is possible to use the manifold housing by means of cast moulding without having the need to use sliders in the mould.

According to another exemplary embodiment of the invention, a cartridge for fluidic applications, and in particular microfluidic applications is provided, wherein the cartridge comprises a manifold housing according to one of the above-described embodiments.

In addition to the above said, it shall be noted that a manifold housing may be an integral part of the cartridge. The cartridge might thus be produced by cast moulding, made for example from plastic materials, such as polymers and may be entirely produced by one cast moulding process using a two part mould without having to use sliders although the manifold housing comprises a plurality of fluidic channels or microfluidic channels.

According to another exemplary embodiment of the invention, the cartridge comprises an extension of the fluidic channel of the manifold housing wherein the extension is formed inside the bottom of the cartridge.

According to another exemplary embodiment of the invention, the cartridge further comprises a manifold core according to one of the embodiments as described above or below.

According to another exemplary embodiment of the invention, the manifold housing and the manifold core are designed in combination in such a way that the manifold housing allows a rotation of the manifold core inside the manifold housing when the manifold core is inserted into the manifold housing.

According to another exemplary embodiment, the manifold housing and the manifold core are designed in combination in such a way that an opening of the fluidic channel in the manifold housing is aligned with an opening in the core in at least one angular position of the core with respect to the manifold housing such that a fluidic connection is established between the fluidic channel and the core.

According to another exemplary embodiment, the manifold housing and the manifold core are designed in combination in such a way that different openings of the fluidic channel in the manifold housing are aligned with different openings in the core in different angular positions of the core with respect to the manifold housing such that different fluidic connections are established at different angular positions of the core.

According to another exemplary embodiment of the invention, a manifold core for inserting into a manifold housing of a cartridge is provided. The manifold core comprises an opening for establishing a fluidic connection with a fluidic channel of the manifold housing when the manifold core is inserted into the manifold housing. Furthermore, the manifold core is adapted for sealing the fluid connection with an oblique inner surface of the manifold housing when the manifold core is inserted into the manifold housing.

In other words the manifold core may also be shaped quasi cylindrical and additionally having an oblique outer surface at a proximal end of the manifold core. This oblique outer surface may then be adapted to provide for the fluid-tight connection in combination with the oblique inner surface of the manifold housing when the connection between the core and the housing is established.

But it is also possible that the manifold core has per se not an oblique shape but is brought into an oblique shape when it is pressed into the proximal region of the manifold housing. In this region the inner oblique surface of the manifold housing is positioned. In other words, the manifold core takes on a oblique shape through insertion into the manifold housing.

Furthermore, the manifold core has at least a corresponding opening for the fluidic channel of the manifold housing.

If the manifold core does not per se have an oblique part, deformable material at the manifold core makes it possible to bring the manifold core into such an oblique shape when corresponding forces are applied to the manifold core during insertion of the core into the housing. In detail, the oblique inner surface of the manifold housing may be annular and may press the manifold core into such a desired oblique shape in order to provide for fluid-tight connection.

According to another exemplary embodiment, the manifold core has got no undercut.

According to another exemplary embodiment of the invention, the manifold core comprises an oblique outer surface, wherein the manifold core has no undercut.

Furthermore, the oblique outer surface comprises elastic materials wherein the oblique outer surface is adapted for sealing the fluid connection with the oblique inner surface of the manifold housing when the manifold core is inserted into the manifold housing.

In other words, the combination of a manifold housing having an oblique inner surface and a manifold core that has a corresponding oblique surface has the advantage of being able to produce such parts by cast moulding without sliders.

According to another embodiment, multiple openings are provided in the manifold core for establishing different fluidic connections with different fluidic channels of the manifold housing when the manifold core is inserted into the manifold housing. For example, at least two of the openings may be arranged at different levels of the core along a longitudinal axis of the core and/or, at least two of the openings may be arranged at different angular positions around the perimeter of the core.

According to another exemplary embodiment of the invention, the oblique surface comprises several compartments in one, more or all of which an opening may be situated respectively, wherein, preferably, the compartments are spatially separated by elastic sealing lips and wherein the compartments and the sealing lips are adapted in such a way that fluid-type connections may be established between a compartment including an opening of the manifold core and one or more corresponding openings/ends of one or more of the fluidic channels of the manifold housing when the manifold core is inserted into the manifold housing subject to the rotational position of the core with respect to the housing. In a given position of the core with respect to the housing, the core and the housing may be designed such that none, one or more fluidic channels in the housing may interact with associated openings in compartments of the core simultaneously. In addition, or alternatively, in different angular positions of the core with respect to the housing, different fluidic channels may interact with different openings of compartments. In this way, for example, by rotating the core e.g. clockwise, at each position of the core a specific fluidic channel may interact with an opening in the core such that different functions such as valve functions, mixing functions, etc. can be realized subsequently simply by rotating the core in the housing.

It has to be noted that the embodiments of the invention are described with reference to different aspects of the invention. In particular, some embodiments are described with reference to manifold housing claims whereas other embodiments are described with reference to manifold core or cartridge claims. However, a person skilled in the art will gather from the above and the following description that unless otherwise notified, in addition to any combination of features belonging to one type of aspect, also any combination between features relating to different aspects is considered to be disclosed with this application.

The aspects defined above and further aspects, features and advantages of the present invention can also be derived from the examples of embodiments to be described hereinafter and are explained with reference to examples of embodiments. The invention will be described in more detail hereinafter with reference to examples of the embodiments but to which the invention is not limited.

BRIEF DESCRIPTION OF THE FIGURES

Similar or relating components in the several figures are provided with the same reference numerals. The view in the figures is schematic and not fully scaled.

DETAILED DESCRIPTIONS OF THE EMBODIMENTS

Figure 1:
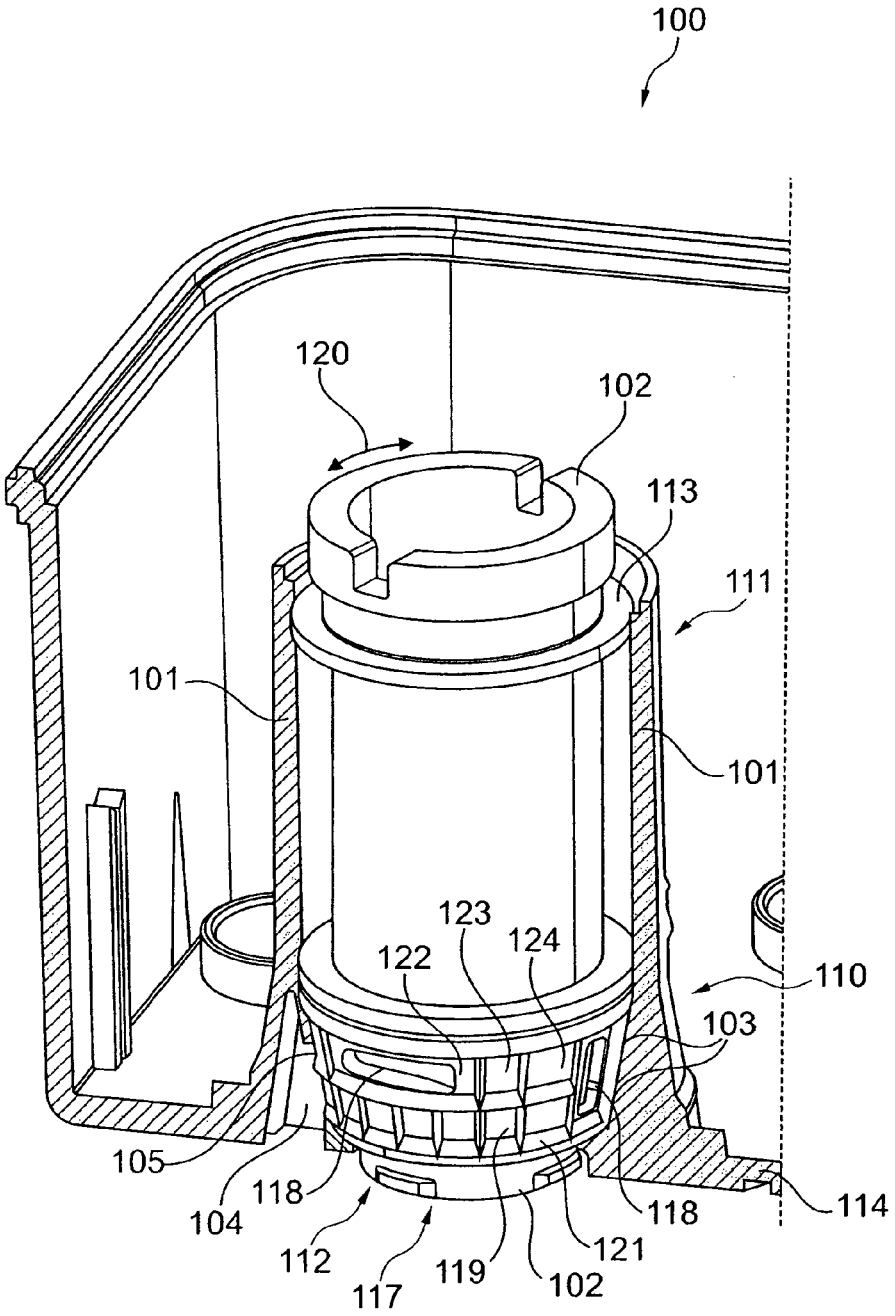
FIG. 1 schematically shows a microfluidic cartridge with a manifold housing and a manifold core according to an exemplary embodiment of the invention.

FIG. 1 shows a 3-dimensional view of a microfluidic cartridge 100 for microfluidic applications. The cartridge comprises a manifold housing 101 which is adapted for receiving a manifold core 102. In the figure, the housing 101 is displayed as cross section to explain the interconnection between the housing 101 and the core 102. By rotating the manifold core 102 inside of the manifold housing 101 various different valve functions in this cartridge 100 may be used due to this manifold system by means of aligning openings 118 in the manifold core 102 with one or more fluidic channels 104 in the manifold housing 101, as will be explained below. In other words, with limited actuation interfaces multiple connections can be made from, for example, a separate instrument (not shown here) to, for example, multiple chambers that are comprised by the microfluidic cartridge 100.

It can be seen that the manifold housing 101 has a conical inner surface 103 that is an annular surface spanning around the inner wall of this hollow cylinder that is formed by the manifold housing 101. Further, a fluidic channel 104 inside the manifold housing 101 can be seen wherein the fluidic channel 104 ends with one of its ends 105 at the conical inner surface 103. As can be seen from FIG. 1 the manifold housing 101 together with the fluidic channel 104 has no undercut and is thus producible by a cast moulding without the need to use sliders.

Furthermore, it can be seen that the conical inner surface 103 is arranged in a proximal region 110 of the manifold housing 101, i.e. at a lower end of the manifold housing 101, which builds the transmission to the rest of the cartridge 100. The manifold housing 101 is an integral part of the microfluidic cartridge 100 and may thus be produced within one process step together with the rest of the cartridge 100. Nevertheless the housing 101 may also be a physically separate component.

Furthermore, it can be seen that the manifold housing 101 essentially has a shape of a hollow cylinder 111 with a first hole 112 at the proximal end and the second hole 113 at the distal end, i.e. the upper end, of the manifold housing 101. The manifold core 102 is inserted into the manifold housing 101 through the second hole 113 on the distal end.

Additionally, the shown manifold core 102 has an opening 118 for establishing a fluid connection with the fluidic channel 104 when the manifold core 102 is inserted. Furthermore, the manifold core 102 is adapted for sealing the fluid connection with the conical inner surface 103 of the manifold housing 101 in an inserted position. In this embodiment of the manifold core 102, this adaption is made by the conical shape of the conical outer surface 119 of the manifold core 102. This manifold core 102 also comprises elastic materials 121 supporting sealing which might for example be a rubber material or any other polymer elastic material. Thus a deformation of the shape of the manifold core 102 is caused when pressure is applied accordingly. Therefore, fluid type connections are sealed by the conical outer surface 119 of the manifold core 102.

Furthermore, the conical outer surface 119 of the manifold core 102 comprises several compartments 122, 123 and 124 in which an opening 118 may be situated respectively. Furthermore, the compartments 122, 123 and 124 are especially separated by elastic sealing lips 125 and 126 (see FIG. 2) which furthermore support the fluid tight connection.

Figure 2:
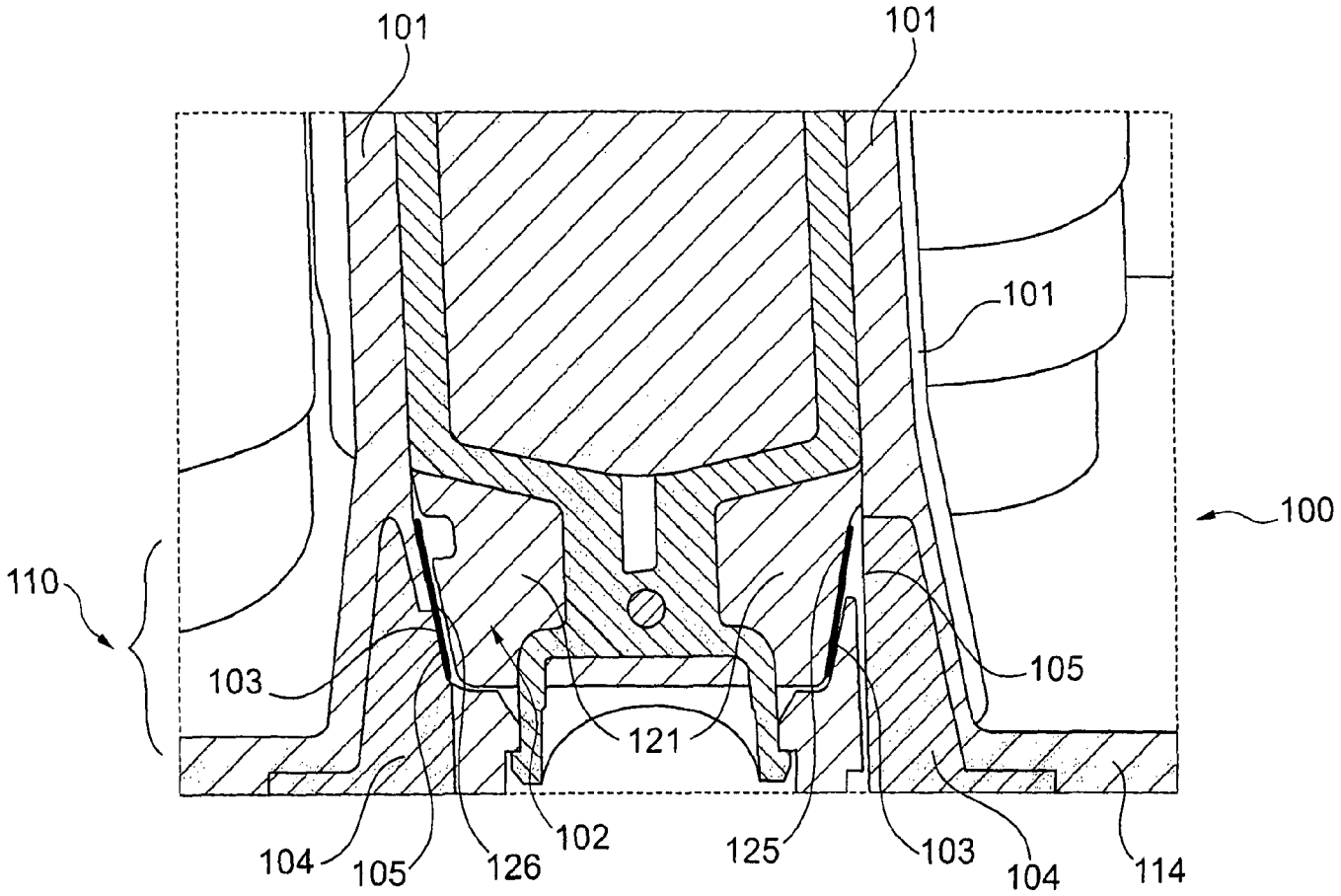
FIG. 2 schematically shows a cross-section through a cartridge with a manifold housing and a manifold core according to another exemplary embodiment of the invention.

FIG. 2 shows a cross-sectional view through a manifold housing 101 in which a manifold core 102 is inserted. This manifold system is part of the microfluidic cartridge 100. It can be seen that the manifold housing 101 has a conical inner surface 103 that is shown on the right hand and on the left hand side. This is due the annular surface spanning around the inner surface of the hollow cylinder. Additionally, two fluidic channels 104 are shown as well as ends 105 of the fluidic channels 104 that are situated on the conical inner surface 103 of the housing 101. As can be derived from FIG. 2, a left hand fluidic channel 104 is provided with a shape different to a right hand fluidic channel 104. The left hand fluidic channel 104 is designed such that its associated end 105 is arranged at a first level of the housing 101 for interacting with an opening in one of the compartments forming a lower ring of compartments in the core 102 as shown in FIG. 1. The right hand fluidic channel 104 is designed such that its associated end 105 is arranged at second level of the housing 101, exceeding the first level, for interacting with an opening 118 in one of the compartments 122, 123 and 124 forming an upper ring of compartments 122, 123 and 124 in the core 102 as shown in FIG. 1. Due to the conical shape of the conical inner surface 103 it is possible to design microfluidic channels inside the manifold housing 101 that in turn make it possible, to produce the manifold housing 101 or an entire microfluidic cartridge 100 by cast moulding without sliders. This is beneficial especially for manifold housings, manifold cores and microfluidic cartridges that are designed on a scale of micrometers like in this present technical field of microfluidics.

It can be seen in FIG. 2 that the manifold core 102 is adapted in such a way, that when the manifold core 102 is inserted into the manifold housing 101, the conical outer surface of the manifold core 102 and the conical inner surface 103 of the manifold housing 101 fit closely and establish a fluid tight connection between the fluidic channel 104 of the manifold housing 101 and the opening of the manifold core 102. Furthermore, the sealing lips 125 and 126 support the fluid tightness.

Figure 3:
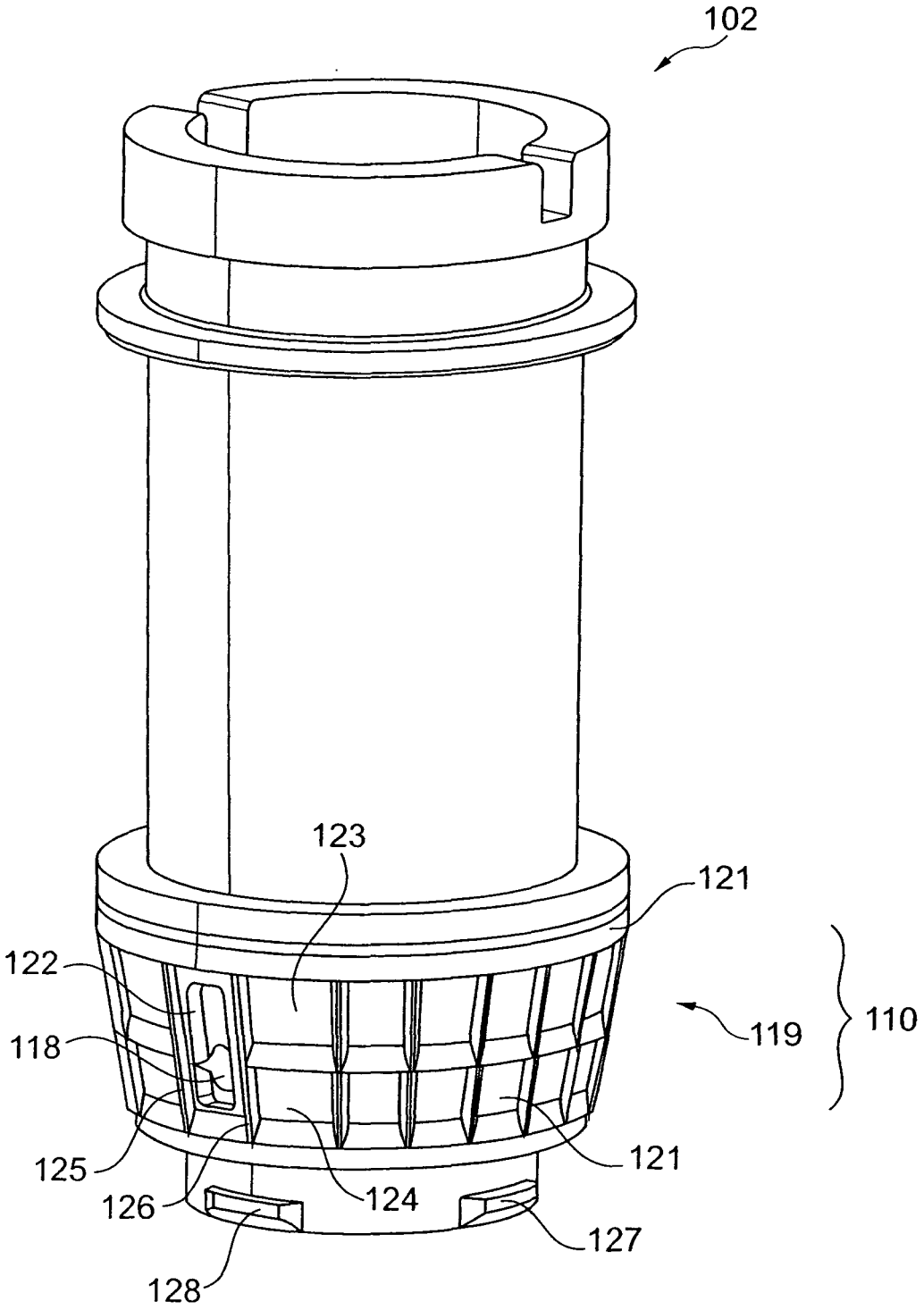
FIG. 3 schematically shows a 3-dimensional view of a manifold core according to another exemplary embodiment of the invention.

FIG. 3 shows a manifold core 102. In a proximal region 110 this hollow cylindrical shape has a truncated conical outer surface 119 on which elastic material 121 is placed. This may be formed out of one piece. Also a two or more part solution is possible in which the core 102 and the elastic material 121 are separate components.

Furthermore, the truncated conical outer surface 119 comprises several compartments 122 to 124 and has elastic sealing lips 125 and 126. Compartment 123 is arranged in an upper ring of compartments. Compartment 124 is arranged in a lower ring of compartments. Compartment 122 with opening 188 extends between the upper and the lower ring of compartments. By means of rotating such a manifold core 102 several different valve functions can be provided to the microfluidic cartridge 100 by means of limited actuation interfaces. This is achieved by way of making different openings in different compartments interact with different fluidic channels 104. By means of designing the ends 105 of the fluidic channels 105 and the compartments 122-124 and its openings respectively, subject to the rotational position of the core 102, none, one or more fluidic channels 104 may interact with associated openings 118 simultaneously. In this way, for example, by rotating the core 102 e.g. clockwise, at each position of the core 102 a specific fluidic channel 104 may interact with an opening 118 in the core such that different functions such as valve functions, mixing functions, etc. can be realized subsequently simply by rotating the core 102 in the the housing 101.

Locking detents 127 and 128 are used to fix the core 102 in the housing 101.

Figure 4:
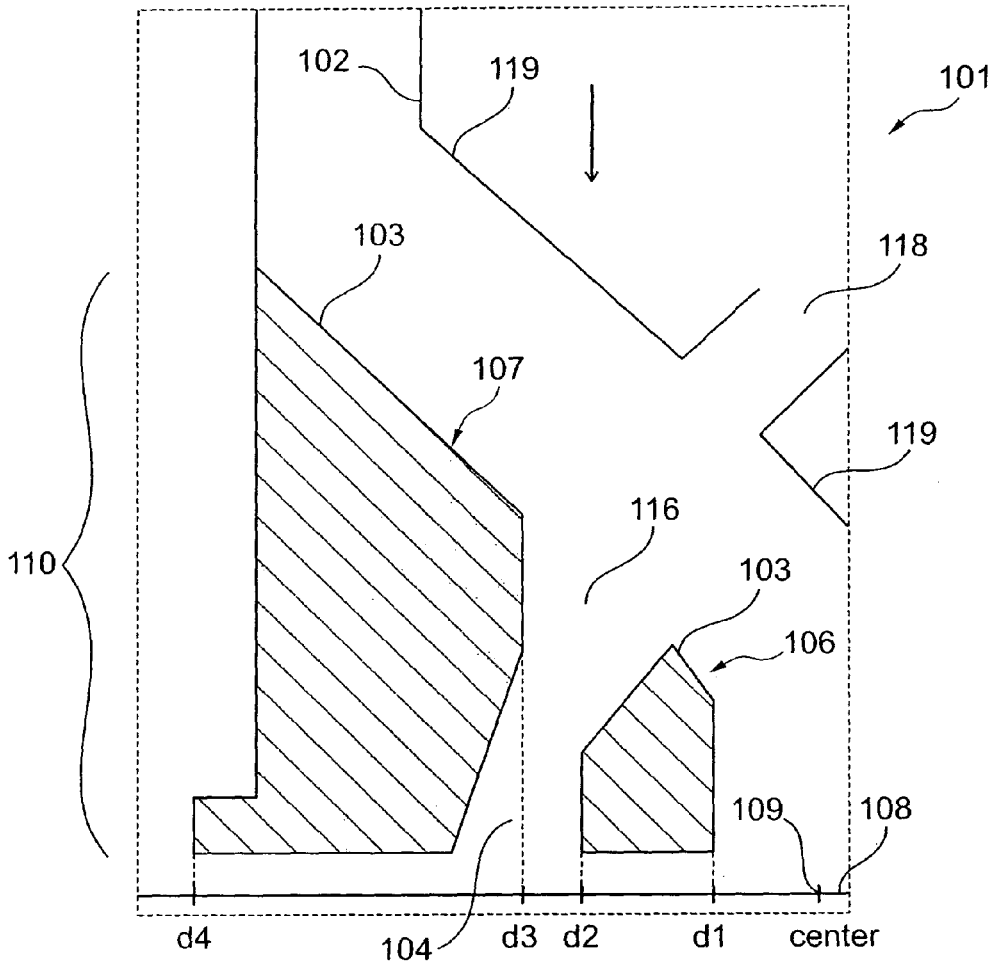
FIG. 4 schematically shows a cross-sectional view through a part of a manifold housing according to another exemplary embodiment of the invention.

FIG. 4 shows a cross-sectional view of the left part of a manifold housing 101 wherein the fluidic channel 104 separates the manifold housing 101 into an inner part 106 and into an outer part 107. For description means a radial direction 108 from a center 109 of the manifold housing 101 to the outer surface on the left hand side is defined. The inner part 106 of the manifold housing 101 extends from a first inner radial value d1 to a first outer radial value d2. Wherein the outer part 107 of the manifold housing 101 extends from a second inner radial value d3 to a second outer radial value d4 and wherein d2 is smaller than d3. In other words, FIG. 4 shows another exemplary embodiment of the manifold housing 101 with a conical surface 103 onto which a manifold core 102 is brought into contact with. The manifold core 102 in turn has a conical outer surface 119 that is adapted to create a fluid tight connection between the opening 118 and a fluidic channel 104 after a complete insertion has been processed. Furthermore, it can be seen, that such a manifold housing 101 which might have a plurality of such shown fluidic channels can be produced by cast moulding without having the need to use sliders.

The invention claimed is:

1. A manifold housing for a fluidic cartridge, wherein the manifold housing is adapted to receive a manifold core, the manifold housing comprising:

an oblique inner surface, wherein the oblique inner surface is oblique to a longitudinal axis of the manifold housing, said oblique inner surface defining a portion of a recess for receiving the manifold core; and at least one fluidic channel, wherein a first end of the fluidic channel ends at the oblique inner surface thereby providing an opening in the oblique inner surface that fluidly connects the fluidic channel with an inner cavity of the manifold housing, said opening is oblique to the longitudinal axis of the manifold housing, wherein the at least one fluidic channel is formed in the manifold housing such that the manifold housing has no undercut surfaces.

2. The manifold housing according to claim 1, wherein the oblique inner surface is a conical inner surface.

3. The manifold housing according to claim 1, wherein the at least one fluidic channel separates the manifold housing, in a cross sectional view, into an inner part and an outer part, wherein in a radial direction extending from a center of the manifold housing to an outer surface of the manifold housing:

(i) the inner part of the manifold housing extends from a first inner radial distance (d1) to a first outer radial distance (d2), (ii) the outer part of the manifold housing extends from a second inner radial distance (d3) to a second outer radial distance (d4), and (iii) the first outer radial distance (d2) is less than the second inner radial distance (d3).

4. The manifold housing according to claim 1, wherein the oblique inner surface is an annular surface arranged in a proximal region of the manifold housing.

5. The manifold housing according to claim 1, wherein the manifold housing further comprises:

a first portion having a shape of a hollow cylinder;

a second portion having the oblique inner surface and being arranged in a proximal region of the manifold housing;

a first hole at a proximal end of the manifold housing; and a second hole at a distal end of the manifold housing, wherein the second hole is dimensioned to receive the manifold core.

6. The manifold housing according to claim 1, wherein the at least one fluidic channel extends in the manifold housing from a bottom of the fluidic cartridge to the oblique inner surface of the manifold housing.

7. The manifold housing according to claim 1, wherein the at least one fluidic channel is adapted to establish a fluidic connection with the manifold core when the manifold core is received in the manifold housing.

8. The manifold housing according to claim 7, wherein the manifold housing has a plurality of said fluidic channels, wherein each of the fluidic channels is adapted to establish different fluidic connections with the manifold core when the manifold core is received in the manifold housing.

9. The manifold housing according to claim 8, wherein at least two of the openings connecting the fluidic channels with the inner cavity of the manifold housing are arranged at different levels of the oblique inner surface along the longitudinal axis of the manifold housing.

10. The manifold housing according to claim 8, wherein at least two of the openings connecting the fluidic channels with the inner cavity of the manifold housing are arranged at different angular positions around a perimeter of the oblique inner surface.

11. The manifold housing according to claim 1, wherein the manifold housing is made by cast molding or by injection molding.

12. The manifold housing according to claim 1, wherein said manifold housing further comprises a cylindrical wall having an inner surface defining a portion of a recess for receiving the manifold core.

13. The manifold housing according to claim 1, wherein said manifold housing further comprises a wall having the oblique inner surface, said oblique inner surface defining a portion of a recess for receiving the manifold core.

14. A cartridge for fluidic applications, comprising:

a manifold housing comprising:

an oblique inner surface, wherein the oblique inner surface is oblique to a longitudinal axis of the manifold housing, said oblique inner surface defining a portion of a recess; and at least one fluidic channel, wherein a first end of the fluidic channel ends at the oblique inner surface thereby providing an opening in the oblique inner surface that fluidly connects the fluidic channel with an inner cavity of the manifold housing, said opening is oblique to the longitudinal axis of the manifold housing, wherein the at least one fluidic channel is formed in the manifold housing such that the manifold housing has no undercut surfaces.

15. The cartridge according to claim 14, wherein an extension portion of the at least one fluidic channel is formed inside a bottom of the cartridge.

16. The cartridge according to claim 14, wherein the cartridge further comprises:

a manifold core dimensioned to be received in the manifold housing.

17. The cartridge according to claim 16, wherein the manifold housing and the manifold core are adapted for combination such that the manifold housing allows a rotation of the manifold core within the inner cavity of the manifold housing when the manifold core is received in the manifold housing.

18. The cartridge according to claim 17, wherein when the manifold core is received in the manifold housing, an opening of the at least one fluidic channel of the manifold housing is aligned with an opening in the manifold core in at least one angular position of the manifold core with respect to the manifold housing such that a fluidic connection is established between the at least one fluidic channel of the manifold housing and the manifold core.

19. The cartridge according to claim 18, wherein when the manifold core is received in the manifold housing different openings of the at least one fluidic channel of the manifold housing are aligned with different openings in the manifold core in different angular positions of the manifold core with respect to the manifold housing such that different fluidic connections are established at different angular positions of the manifold core.

20. The cartridge according to claim 16, wherein said oblique inner surface defines a portion of a recess for receiving the manifold core.

21. A manifold core for insertion into a manifold housing that includes (a) an oblique inner surface, wherein the oblique inner surface is oblique to a longitudinal axis of the manifold housing and defines a portion of a recess for receiving the manifold core, and (b) at least one fluidic channel, wherein a first end of the fluidic channel ends at the oblique inner surface thereby providing an opening in the oblique inner surface that fluidly connects the fluidic channel with an inner cavity of the manifold housing, said opening is oblique to the longitudinal axis of the manifold housing, wherein the at least one fluidic channel is formed in the manifold housing such that the manifold housing has no undercut surfaces, the manifold core comprising:

at least one opening for establishing a fluidic connection with the at least one fluidic channel of the manifold housing when the manifold core is inserted into the manifold housing, wherein the manifold core is adapted for sealing the fluidic connection with the oblique inner surface of the manifold housing when the manifold core is inserted into the manifold housing.

22. The manifold core according to claim 21, wherein the manifold core further comprises:

an oblique outer surface comprised of an elastic material, wherein the oblique outer surface of the manifold core seals the fluidic connection with the oblique inner surface of the manifold housing when the manifold core is inserted into the manifold housing.

23. The manifold core according to claim 22, wherein the oblique outer surface of the manifold core is a conical outer surface.

24. The manifold core according to claim 22, wherein the oblique outer surface of the manifold core includes a plurality of compartments in each of which an opening is situated respectively, the plurality of compartments spatially separated by elastic sealing lips, wherein the plurality of compartments and the sealing lips are adapted to establish fluid tight connections between each compartment of the manifold core and the corresponding opening of the at least one fluidic channel of the manifold housing when the manifold core is inserted into the manifold housing.

25. The manifold core according to claim 21, wherein the manifold core further comprises:

multiple openings for establishing different fluidic connections with different fluidic channels of the manifold housing when the manifold core is inserted into the manifold housing.

26. The manifold core according to claim 25, wherein at least two of the multiple openings arc arranged at different levels of the manifold core along a longitudinal axis of the manifold core.

27. The manifold core according to claim 25, wherein at least two of the multiple openings are arranged at different angular positions around a perimeter of the manifold core.

28. The manifold core according mg to claim 21, wherein said manifold core has no undercut surfaces.

* * * * *